US007262675B2

(12) United States Patent
Lee et al.

(10) Patent No.: US 7,262,675 B2
(45) Date of Patent: Aug. 28, 2007

(54) LAMINATED FILTER WITH IMPROVED STOP BAND ATTENUATION

(75) Inventors: Dong Hwan Lee, Kyungki-do (KR); Sung Yeol Park, Kyungki-do (KR); Ki Pyo Hong, Kyungki-do (KR); Hee Soo Yoon, Kyungki-do (KR)

(73) Assignee: Samsung Electro-Mechanics Co., Ltd. (KR)

( * ) Notice: Subject to any disclaimer, the term of this patent is extended or adjusted under 35 U.S.C. 154(b) by 39 days.

(21) Appl. No.: 11/126,361

(22) Filed: May 11, 2005

(65) Prior Publication Data

US 2006/0181370 A1 Aug. 17, 2006

(30) Foreign Application Priority Data

Feb. 16, 2005 (KR) ..... 10-2005-0012874

(51) Int. Cl.
*H01P 3/08* (2006.01)

(52) U.S. Cl. ..... 333/185; 333/184; 333/204

(58) Field of Classification Search ..... 333/175, 333/177, 184, 185
See application file for complete search history.

(56) References Cited

U.S. PATENT DOCUMENTS 5,448,209 A * 9/1995 Hirai et al. ..... 333/204
6,414,568 B1 * 7/2002 Matsumura et al. ..... 333/185
6,437,665 B1 8/2002 Kato
6,583,687 B2 * 6/2003 Nosaka ..... 333/175
6,587,020 B2 * 7/2003 Tojyo ..... 333/185
6,768,399 B2 * 7/2004 Uriu et al. ..... 333/204

FOREIGN PATENT DOCUMENTS

| | | |
|---|---|---|
| JP | 05-283904 | 10/1993 |
| JP | 405335866 A * | 12/1993 |
| JP | 06-120703 | 4/1994 |
| JP | 08-097603 | 4/1996 |
| JP | 11-284402 | 10/1999 |
| JP | 2002-374102 | 12/2002 |
| JP | 2004-112787 | 4/2004 |
| JP | 2004-266697 | 9/2004 |
| JP | 2004-328337 | 11/2004 |

* cited by examiner

*Primary Examiner*—Robert Pascal
*Assistant Examiner*—Kimberly E Glenn
(74) *Attorney, Agent, or Firm*—McDermott Will & Emery LLP

(57) ABSTRACT

Disclosed herein is a laminated filter with improved stop band attenuation, which is adopted in devices using a radio frequency, such as communication systems and/or broadcasting systems. The laminated filter forms cross capacitive coupling as feeding lines of input lead and/or output lead are coupled to a resonator pattern, and enhances an attenuation characteristic of stop band. Also, the laminated filter is minimized if feeding lines of the input lead and output lead are aligned in different layers, and the positions of the attenuation poles are easily controlled by adjusting the feeding line length.

7 Claims, 12 Drawing Sheets

LAMINATED FILTER WITH IMPROVED STOP BAND ATTENUATION

RELATED APPLICATIONS

The present application is based on, and claims priority from, Korean Application Number 2005-12874, filed Feb. 16, 2005, the disclosure of which is incorporated by reference herein in its entirety.

BACKGROUND OF THE INVENTION

1. Field of the Invention

The present invention relates to a laminated filter adopted to devices using a radio frequency (RF), such as communication systems and/or broadcasting systems, and more particularly to a laminated filter capable of forming cross capacitive coupling as feeding lines of input lead and/or output lead are coupled to a resonator pattern, enhancing an attenuation characteristic of stop band, being minimized if feeding lines of the input lead and output lead are aligned in different layers, and easily adjusting a position of attenuation pole based on adjustment of feeding line length.

2. Description of the Related Art

Generally, a band pass filter passing signals with a specific frequency band includes a plurality of LC resonators. For example, a prior art laminated filter is depicted in FIG. 1.

FIG. 1 is an exploded perspective view of a prior art laminated filter.

As shown in FIG. 1, the prior art laminated filter is formed to include dielectric cover sheets 11A and 11B laminated atop one another. Dielectric grounding sheets 12A and 12B are stacked on the inner sides of the dielectric cover sheets 11A and 11B, respectively, and form grounding electrodes G1 and G2 thereon, respectively. Three dielectric sheets 13, 14 and 15 are placed between the dielectric grounding sheets 12A and 12B. The dielectric sheet 13 forms input and output feeding lines 13*a* and 13*b* to be connected to external input and output electrodes, respectively, placed at both sides thereof. Capacitor patterns 13*c* and 13*d*, respectively connected to the input and output feeding lines 13*a* and 13*b*, are formed on the dielectric sheet 13.

Also, the dielectric sheet 14 forms first and second parallel resonator patterns Q1 and Q2 thereon, whose lengths are smaller than $\lambda/4$ with respect to a center frequency, respectively. The first and second parallel resonator patterns Q1 and Q2 are arranged so as to face the capacitor patterns 13*c* and 13*d*, respectively. The first and second resonator patterns Q1 and Q2 are coupled in parallel to one another in a mutual electro-magnetic coupling fashion.

The dielectric sheet 15 forms a coupling capacitor pattern 15*a* thereon, in which the coupling capacitor pattern 15*a* forms additional electric coupling between the first and second resonator patterns Q1 and Q2. The coupling capacitor pattern 15*a* can adjust the amount of mutual coupling of two-pole filter, form an attenuation pole at a stop band, and control the amount of mutual coupling such that the position of the attenuation pole of the stop band can be adjusted.

FIG. 2 is an equivalent circuit diagram of the prior art laminated filter of FIG. 1.

As shown in FIG. 2, IN and OUT correspond to an input lead and an output lead, respectively. C1 and L1 form an LC equivalent circuit of a first resonator pattern Q1. C2 and L2 form an LC equivalent circuit of the second resonator pattern Q2. C3 and L3 form an LC equivalent circuit by the mutual electromagnetic coupling between the first and second resonator patterns Q1 and Q2. Also, C4 is the capacitance between the first resonator pattern Q1 and the capacitor pattern 13*c*, C6 is the capacitance between the second resonator pattern Q2 and the capacitor pattern 13*d*, and C6 is the capacitance between both of the first and second resonator patterns Q1 and Q2 and the coupling capacitor pattern 15*a*. FL1 and FL2 correspond to the input and the output feeding lines 13*a* and 13*b*, respectively.

FIG. 3 is graphs illustrating attenuation characteristic of the prior art laminated filter of FIG. 1, in which the graphs are of insertion loss S21 and reflection loss S11 with respect to a center frequency fo of approximately 2.45 GHz. Also, an attenuation pole P1 is shown at 6.8 GHz.

However, in the prior art laminated filter, the coupling of the capacitor patterns 13*c* and 13*d* only with a corresponding resonator pattern of the first and second resonator patterns is advantageous in that it restricts enhancement in attenuation characteristics. Also, since the input and output feeding lines 13*a* and 13*b* are formed on the same ceramic sheet, the prior art laminated filter has a drawback in that adjustment of the area and length of the capacitor is restricted.

FIG. 4 is an exploded perspective view of another prior art laminated filter.

In the laminated LC filter of FIG. 4, input and output capacitor patterns 72 and 73 are formed on a ceramic sheet 52. Here, the ceramic sheet 52 also forms a coupling capacitor pattern 62 thereon. The input capacitor pattern 72 is arranged so as to face inductor patterns 54*a* and 54*b* and is formed by a capacitive coupling in the LC resonator pattern Q1. One end of the input capacitor pattern 72 is connected to an input electrode exposed at the left side of the ceramic sheet 52. The output capacitor pattern 73 is arranged so as to face the inductor patterns 55*a* and 55*b* and is formed by capacitive coupling at the LC resonator pattern Q2. The one end of the output capacitor pattern 73 is connected to the output electrode exposed at the right side of the ceramic sheet 52.

The coupling capacitor pattern 62 and the input and output capacitor patterns 72 and 73 are arranged between the inductor patterns 54*a*, 55*a*, 54*b* and 55*b* formed on the ceramic sheet 52.

As such, since the coupling capacitor pattern 62 and the input and output capacitor patterns 72 and 73 do not block the magnetic field H caused by the inductors L1 and L2, the magnetic field H is uniformly generated such that relatively large inductance can be acquired. Here, reference numerals 60*a* and 60*b* denote a shield pattern, reference numerals 58*a*, 59*a*, 58*b*, and 59*b* denote a capacitor pattern, and reference numerals 56*a*, 57*a*, 56*b* and 57*b* denote wide width parts connected to the inductor patterns 54*a*, 55*a*, 54*b* and 55*b*.

Such a prior art filter has been disclosed in U.S. Pat. No. 6,437,665 B1.

However, similar to the laminated filter shown in FIG. 1, since the prior art filter disclosed in U.S. Pat. No. 6,437,655 B1 is constructed such that the input and output capacitor patterns form capacitive coupling as the input and output capacitor patterns are coupled to corresponding inductor patterns, respectively, it restricts enhancement in attenuation characteristics.

Also, since the input and output capacitor patterns are formed on the same ceramic sheet, the prior art filter has a drawback in that adjustment of the area and the length of the capacitor is restricted.

SUMMARY OF THE INVENTION

Therefore, the present invention has been made in view of the above problems, and it is an object of the present invention to provide a laminated filter capable of forming cross capacitive coupling as feeding lines of input lead and/or output lead are coupled to a resonator pattern, and of enhancing an attenuation characteristic of stop band.

Also, it is another object of the present invention to provide a laminated filter capable of being minimized if feeding lines of the input lead and output lead are aligned in different layers, and easily controlling positions of attenuation poles based on adjustment of the length of feeding line.

In accordance with the present invention, one aspect can be accomplished by the provision of a laminated filter with improved stop band attenuation comprising: a laminated structure, a plurality of resonator patterns, a first mutual capacitor pattern, a first feeding line, a second mutual capacitor pattern, a second feeding line, and coupling capacitor pattern. The laminated structure includes a plurality of dielectric layers and input and output electrodes formed at external sides of the plurality of electric layers. Each of the plurality of resonator patterns is separately formed at a first one of the plurality of dielectric layers with a predetermined interval. The first mutual capacitor pattern is formed at a second dielectric layer adjacent to the first dielectric layer, in which the first mutual capacitor pattern is arranged to face a part of one or more resonator patterns of the plurality of resonator patterns to form capacitive coupling. The first feeding line is formed at the second dielectric layer, in which the first feeding line has an end connected to the first mutual capacitor pattern and another end connected to the input electrode or the output electrode. The second mutual capacitor pattern is formed at a third dielectric layer adjacent to one side of the first dielectric layer, in which the second mutual capacitor pattern is arranged to face a part of one or more resonator patterns of the plurality of resonator patterns to form capacitor coupling. The second feeding line is formed at the third dielectric layer, in which the second feeding line has an end connected to the second mutual capacitor pattern and another end connected to the input electrode or the output electrode. The coupling capacitor pattern is formed on the third dielectric layer and spaced from the second capacitor pattern and the second feeding line, in which the coupling capacitor pattern is arranged to face each of two or more resonators of the plurality of resonator patterns to form cross capacitive coupling.

In accordance with the present invention, another aspect can be accomplished by the provision of a laminated filter with improved stop band attenuation comprising: a laminated layer, a plurality of resonator patterns, a first mutual capacitor pattern, a second mutual capacitor pattern, a first feeding line, a second feeding line, and a coupling capacitor pattern. The laminated layer includes a plurality of dielectric layers and input and output electrodes formed at external sides of the plurality of dielectric layers. Each of the plurality of resonator patterns is separately formed at a first one of the plurality of dielectric layers with a predetermined interval. The first mutual capacitor pattern is formed at a second dielectric layer adjacent to one side of the first dielectric layer, in which the first mutual capacitor pattern is arranged to face a part of one or more resonator patterns of the plurality of resonator patterns to form capacitor coupling. The second mutual capacitor pattern is formed on the second dielectric layer and apart from the first mutual capacitor pattern, in which the second mutual capacitor pattern is arranged to face a part of one or more resonator pattern of the plurality of resonator patterns to form capacitive coupling. The first feeding line is formed at the second dielectric layer, in which the first feeding line has an end connected to the first mutual capacitor pattern and another end connected to the input electrode or the output electrode. The second feeding line is formed at the second dielectric layer, in which the second feeding line has an end connected to the second mutual capacitor pattern and another end connected to the input electrode or the output electrode. The coupling capacitor pattern is formed on the third dielectric layer adjacent to one side of the first dielectric layer, in which the coupling capacitor pattern is arranged to face each of two or more resonators of the plurality of resonator patterns to form cross capacitive coupling therebetween.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
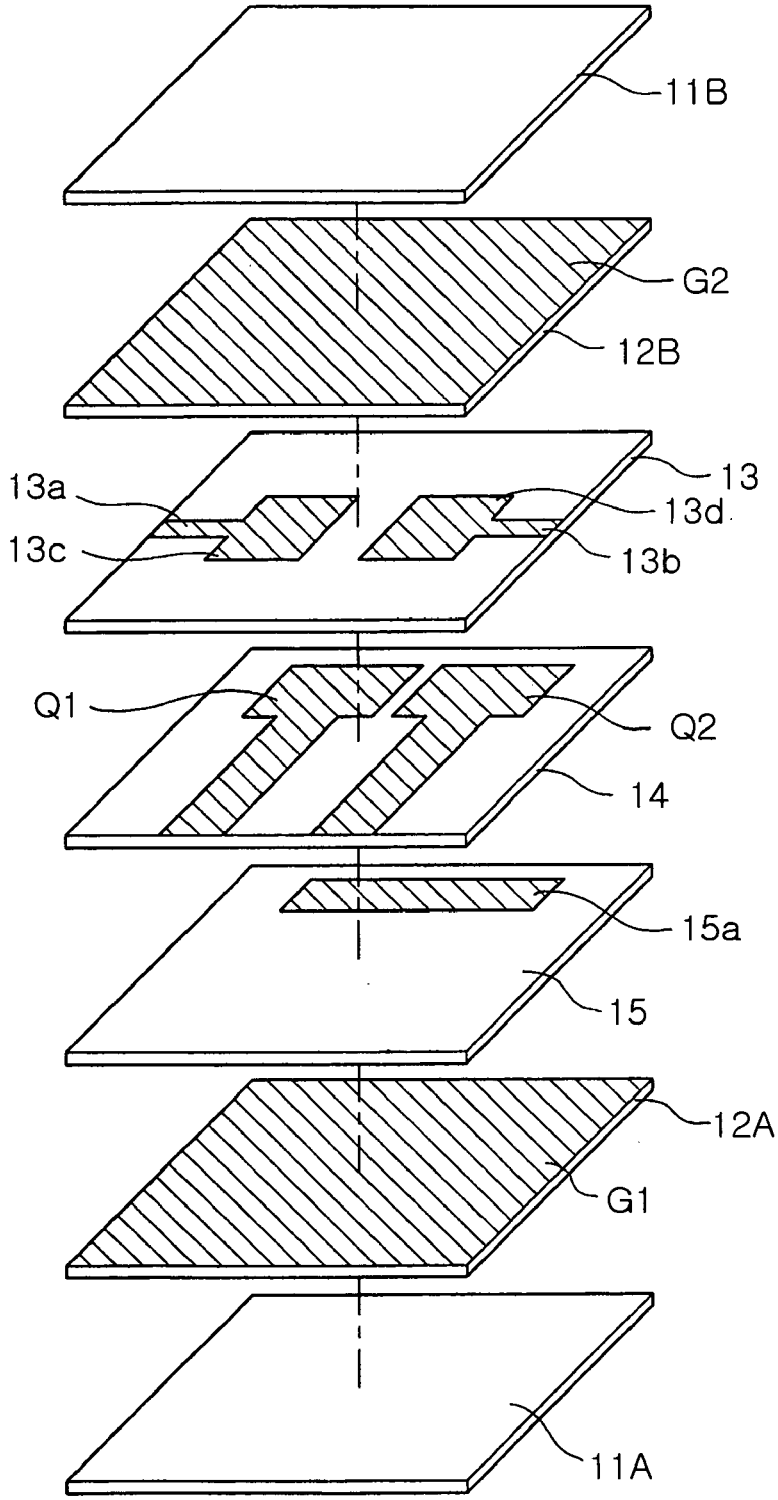
Prior art FIG. 1
FIG. 1 is an exploded perspective view of a prior art laminated filter.
Figure 2:
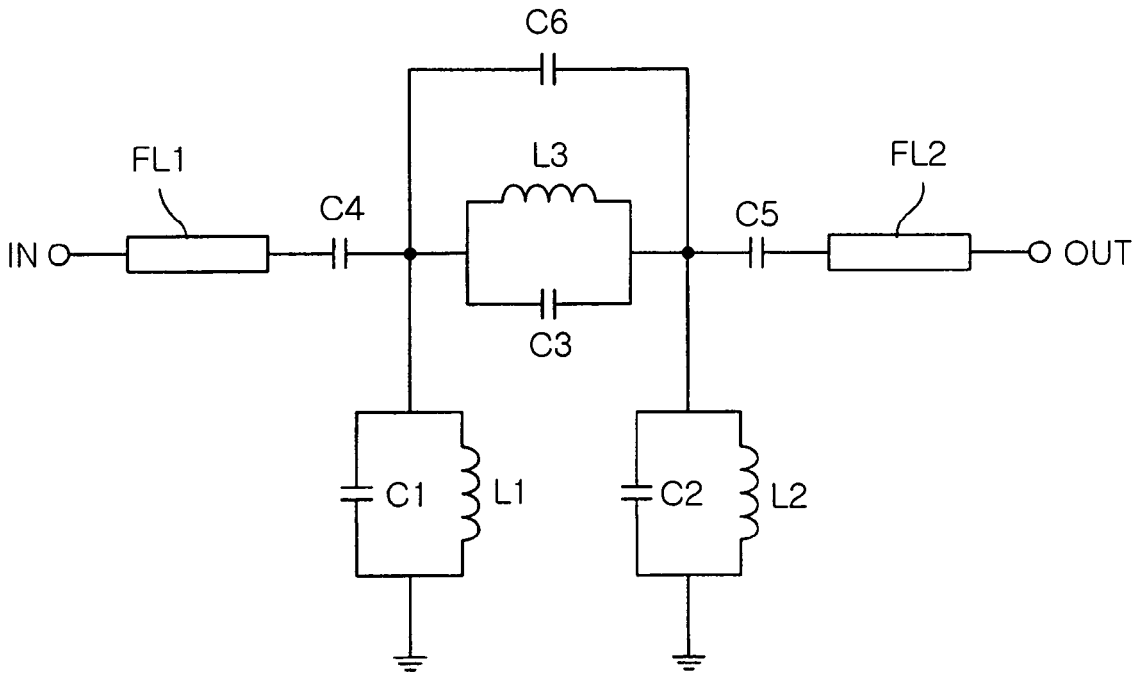
Prior art FIG. 2
FIG. 2 is an equivalent circuit diagram of the prior art laminated filter of FIG. 1.
Figure 3:
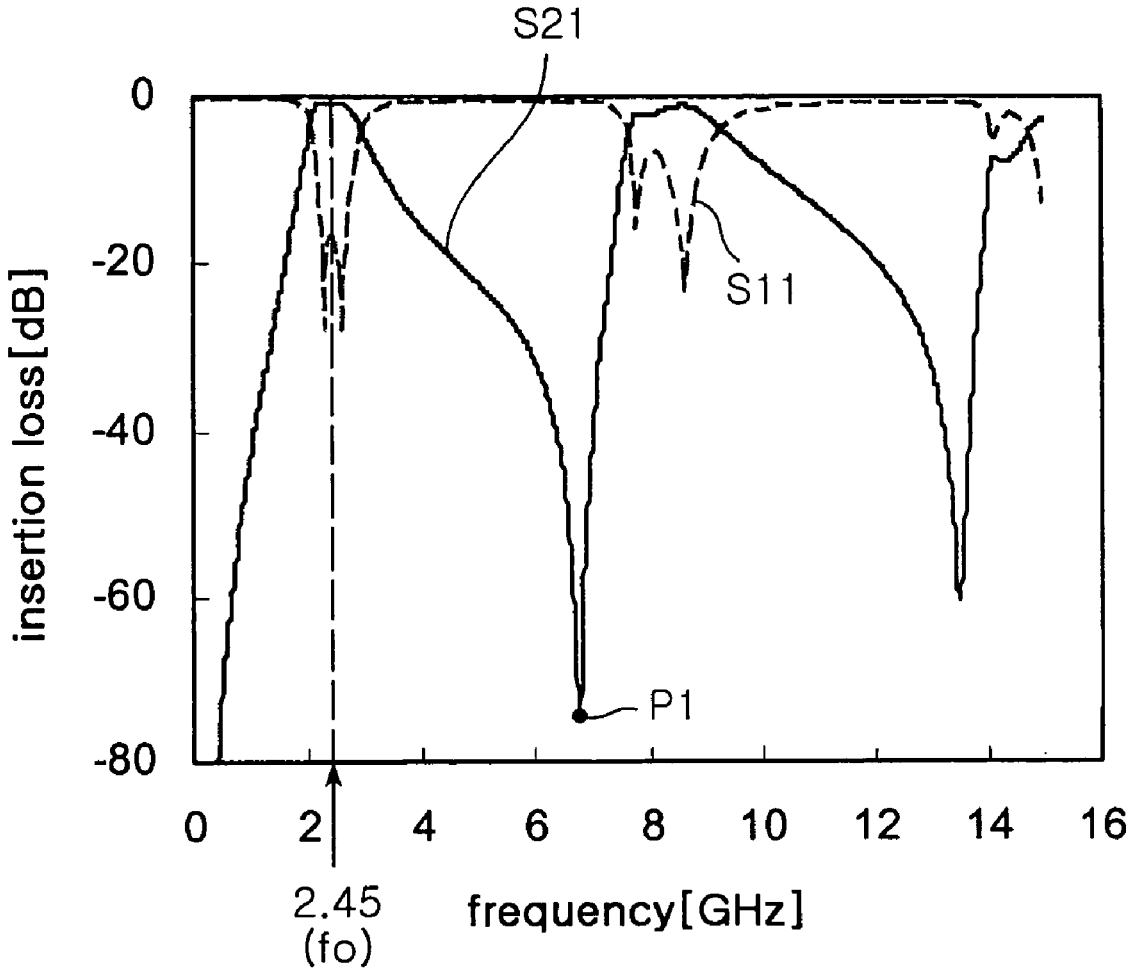
Prior art FIG. 3
FIG. 3 is graphs illustrating attenuation characteristic of the prior art laminated filter of FIG. 1.
Figure 4:
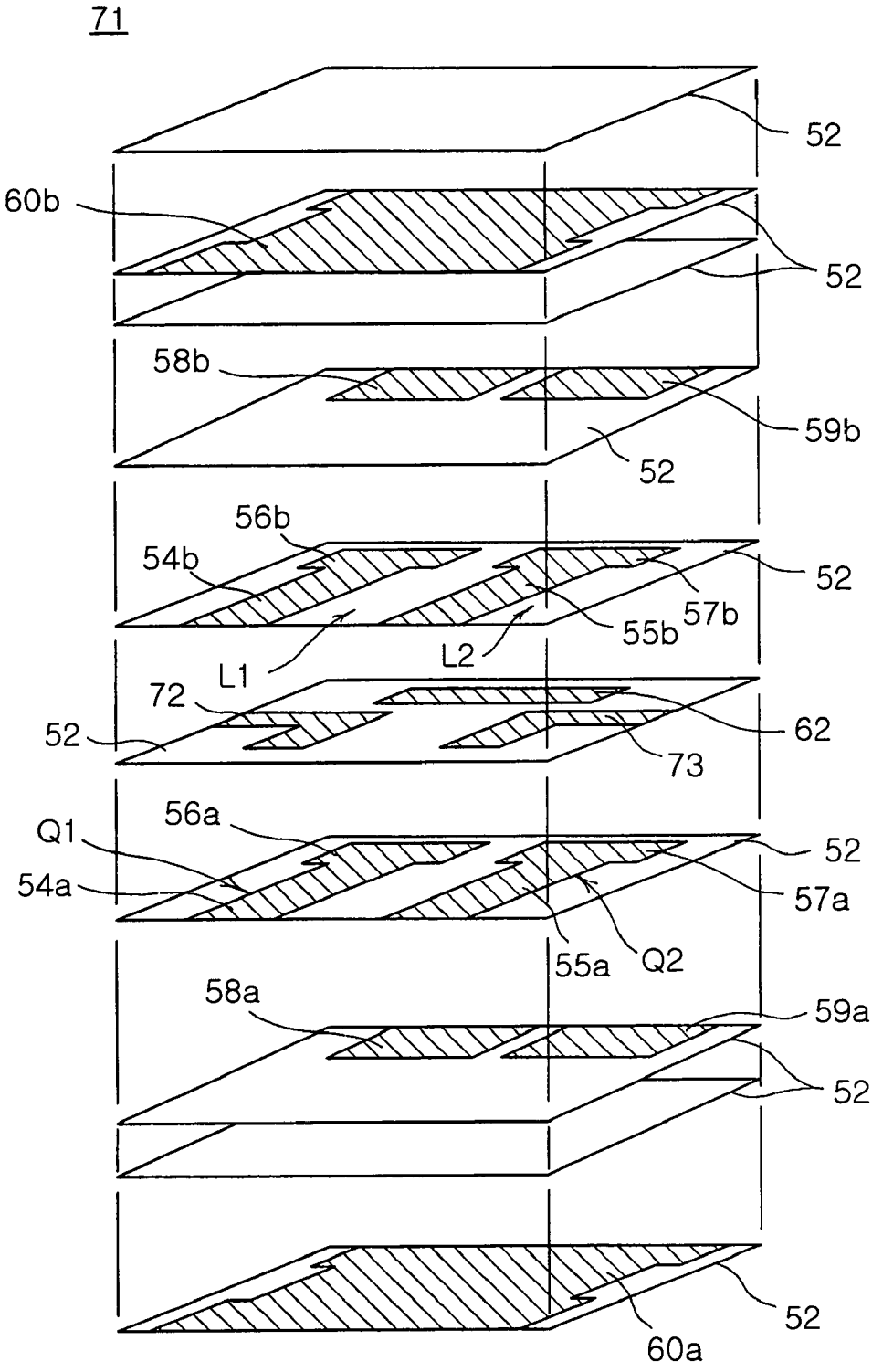
Prior art FIG. 4
FIG. 4 is an exploded perspective view of another prior art laminated filter.

Now, preferred embodiments of the present invention will be described in detail with reference to the annexed drawings. In the drawings, the same or similar elements are denoted by the same reference numerals even though they are depicted in different drawings.

Figure 5:
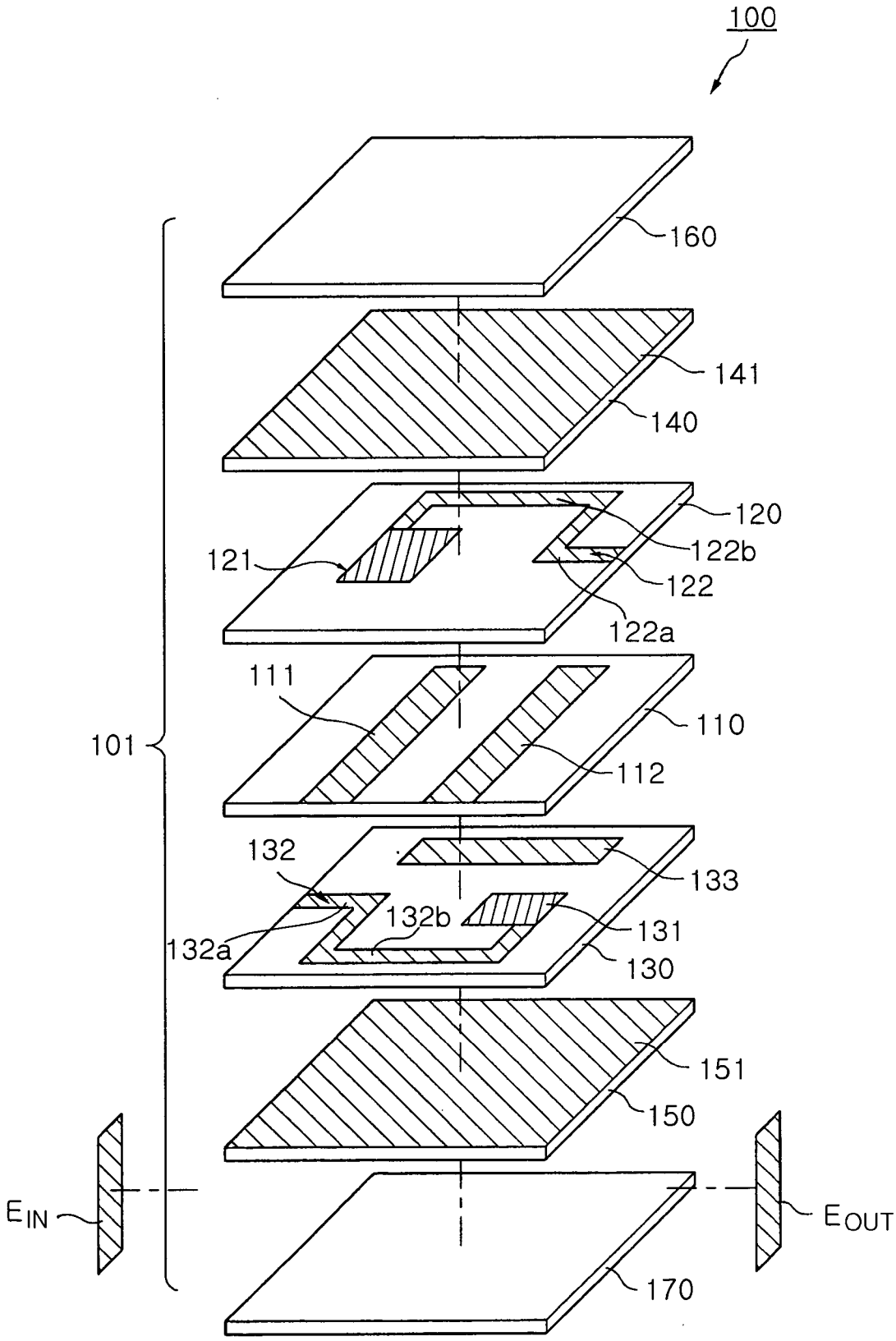
FIG. 5 is an exploded perspective view according to a first embodiment of the present invention.

FIG. 5 is an exploded perspective view according to a first embodiment of the present invention.

With reference to FIG. 5, the laminated filter of the first embodiment of the present invention includes a laminated layer 100, first and second resonator patterns 111 an 112, a first mutual capacitor pattern 121, a first feeding line 122, a second mutual capacitor pattern 131, a second feeding line 132 and a coupling capacitor pattern 133.

The laminated structure 100 includes a plurality of dielectric layers 101, and input and output electrodes Ein and Eout on the external sides of the plurality of dielectric layers 101.

The first and second resonator patterns 111 and 112 are placed on a first dielectric layer 110, in which the first and second resonator patterns 111 and 112 are formed in parallel and spaced apart from one another by a predetermined distance. Although the first and second resonator patterns 111 and 112 according to the present invention are implemented as is depicted in the FIG. 5, their shapes are not limited thereto.

The first mutual capacitor pattern 121 is formed on a second dielectric layer 120 adjacent to one side of the first dielectric layer 110, and is arranged so as to face a part of one or more of the first and second resonator patterns 111 and 112 to form capacitive coupling therebetween.

The first feeding line 122 is formed on the second dielectric layer 120, and is connected at one end thereof to the first mutual capacitor pattern 121 and at the other end to the input electrode Ein or the output electrode Eout.

The second mutual capacitor pattern 131 is formed on a third dielectric layer 130 adjacent to the other side of the first dielectric layer 110, and is arranged so as to face a part of one or more of the resonator pattern of the first and second resonator patterns 111 and 112 to form capacitive coupling therebetween.

The second feeding line 132 is formed on the third dielectric layer 130, and is connected at one end thereof to the second mutual capacitor pattern 131 and at the other end to the output electrode Eout or the input electrode Ein.

The coupling capacitor pattern 133 is formed on the third dielectric layer 130, and apart from the second capacitor pattern 131 and the second feeding line 132 with a predetermined distance. The coupling capacitor pattern 133 is arranged so as to face each of the first and second resonator patterns 111 and 112 to form capacitive coupling therebetween.

The laminated filter according to the present invention includes grounding electrodes 141 and 151 formed at a fourth dielectric layer 140 and/or a fifth dielectric layer 150, in which the fourth dielectric layer 140 is adjacent to one side of the second dielectric layer 120 and the fifth dielectric layer 150 is adjacent to one side of the third dielectric layer 130, and sixth and seventh dielectric layers 160 and 170, in which the sixth dielectric layer 160 is adjacent to the fourth dielectric layer 140 and the seventh dielectric layer 170 is adjacent to the fifth dielectric layer 150. Also, the sixth and seventh dielectric layers 160 and 170 can function as cover layers.

On the other hand, the grounding electrodes 141 and 151 are electrically connected to the resonator patterns through side termination or via hole.

The first and second resonator patterns 111 and 112 have a resonator pattern shaped as a parallel connection wire whose length is smaller than $\lambda/4$ at a center frequency. The first and second resonator patterns 111 and 112 are mutually coupled to one another on an electromagnetic coupling therebetween. Also, additional cross capacitive couplings are formed between the coupling capacitor pattern 133 and each of the respective first and second resonator patterns 111 and 112 such that an attenuation pole can be formed at a stop band. In addition, the coupling capacitor pattern 133 controls the amount of mutual coupling of 2-pole band pass filter such that position of attenuation pole of the stop band can be adjusted. As such, the first and second resonator patterns 111 and 112 and the coupling capacitor pattern 133 are applied to all the embodiments of the present invention.

The first mutual capacitor pattern 121 is wider than the first feeding line 122, so as to form capacitive coupling associating with the first resonator pattern 111. Also, the second mutual capacitor pattern 131 is wider than the second feeding line 132 to form capacitive coupling as the second mutual capacitor pattern 131 is coupled to the second resonator pattern 112.

The first feeding line 122 includes a first pattern 122*a* connected to the input electrode Ein or the output electrode Eout, and a second pattern 122*b* connecting the first pattern 122*a* to the first mutual capacitor pattern 121. The second pattern 122*b* is formed to be superposed with each of the first and second resonator patterns 111 and 112 to form capacitive coupling as the second pattern 122*b* is coupled to the first and the second resonator patterns 111 and 112. Also, the second pattern 122*b* of the first feeding line 122 is superposed with the coupling capacitor pattern 133 to form capacitive coupling associating with the coupling capacitor pattern 133.

Also, the second feeding lien 132 includes a first pattern 132*a* connected to the input and output electrodes Ein and Eout, and a second pattern 132*b* connecting the first pattern 132*a* to the second mutual capacitor pattern 131. The second pattern 132*b* is formed to be superposed with each of the first and second resonator patterns 111 and 112 to form capacitive coupling as the second pattern 132*b* is coupled to the first and second resonator patterns 111 and 112.

As shown in FIG. 5, unlike the prior art laminated filter, the first embodiment of the present invention is implemented to be formed such that the first and second mutual capacitor patterns 121 and 131 are formed at the different dielectric layers, and the first and second feeding lines 122 and 132 are also formed at the different dielectric layers, thereby creating a space at the dielectric layer on which the first and second feeding lines 122 and 132. Therefore, it can be variously formed to be electrically coupled to other patterns or to have an electrical length corresponding to a using frequency.

More specifically, if the respective first and second feeding lines 122 and 132 are formed from an area superposed with the first resonator pattern 111 to an area superposed with the second resonator pattern 112, the first and second feeding lines 122 and 132 form cross capacitive couplings as the first and second feeding lines 122 and 132 are coupled to parts of the first and second resonator patterns 111 and 112. Namely, the cross capacitive couplings are formed between the first feeding line 122 and the first and second resonator patterns 111 and 112, and between the second feeding line 132 and the first and second resonant patterns 111 and 112.

On the other hand, the first and second feeding lines 122 and 132 are coupled by capacitive coupling. Also, an additional capacitive coupling is formed between the first feeding line and the coupling capacitive pattern 133.

As mentioned above, due to the capacitive couplings between the first and second resonator patterns 111 and 112 and between the first and the second feeding lines, and the capacitive coupling formed between the first feeding line 122 and the coupling capacitive pattern 133, an attenuation pole can be additionally generated at the pass band. Here, it is easily appreciated that the positions of attenuation poles are adjusted at a stop band as the amount of capacitive coupling and the lengths of the first and second feeding lines 122 and 132 are adjusted.

Figure 6:
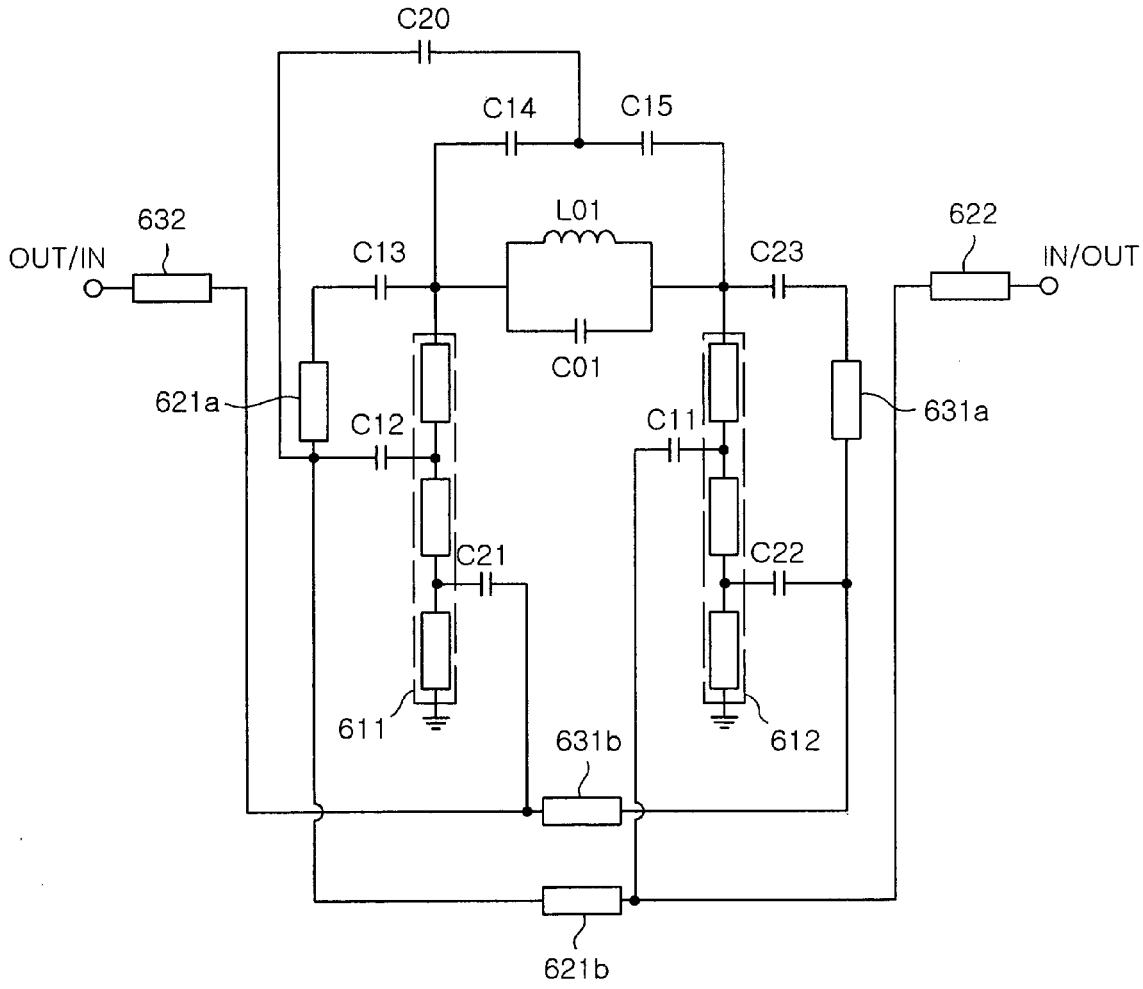
FIG. 6 is an equivalent circuit of the laminated filter of FIG. 5.

FIG. 6 is an equivalent circuit of the laminated filter of FIG. 5.

Reference numerals 622 and 623 correspond to the first patterns 122*a* and 132*a* of the first and the second feeding lines 122 and 132, respectively. Reference numerals 611 and 612 correspond to the first and the second resonator patterns 111 and 112. Reference numerals 621*a* and 621*b* correspond to the second pattern 122*b* of the first feeding line 122, and reference numerals 631*a* and 631*b* correspond to the second pattern 132*b* of the second feeding line 132.

L01 and C01 correspond to an inductance and a capacitance, respectively, which are caused by electro-magnetic coupling between the first and the second resonator patterns 111 and 112, which are coupled to one another in parallel.

C11 corresponds to a capacitance between the second pattern 122*b* of the first feeding line 122 and the second resonator pattern 112, C12 corresponds to a capacitance between the second pattern 122*b* of the first feeding line 122 and the first resonator pattern 111, and C13 corresponds to a capacitance between the mutual capacitor pattern 121 and the first resonator pattern 111.

C21 denotes a capacitance between the second pattern 132*b* of the second feeding line 132 and the first resonator pattern 111, C22 denotes a capacitance between the second pattern 132*b* of the second feeding line 132 and the second resonator pattern 112, and C23 denotes a capacitance between the second mutual capacitor pattern 131 and the first resonator pattern 111.

C14 denotes a capacitance between the coupling capacitor pattern 133 and the first resonator pattern 111. C15 denotes a capacitance between the coupling capacitor pattern 133 and the second resonator pattern 112. C20 denotes a capacitance between the coupling capacitor pattern 133 and the second pattern 122*b* of the first feeding line 122.

Figure 7:
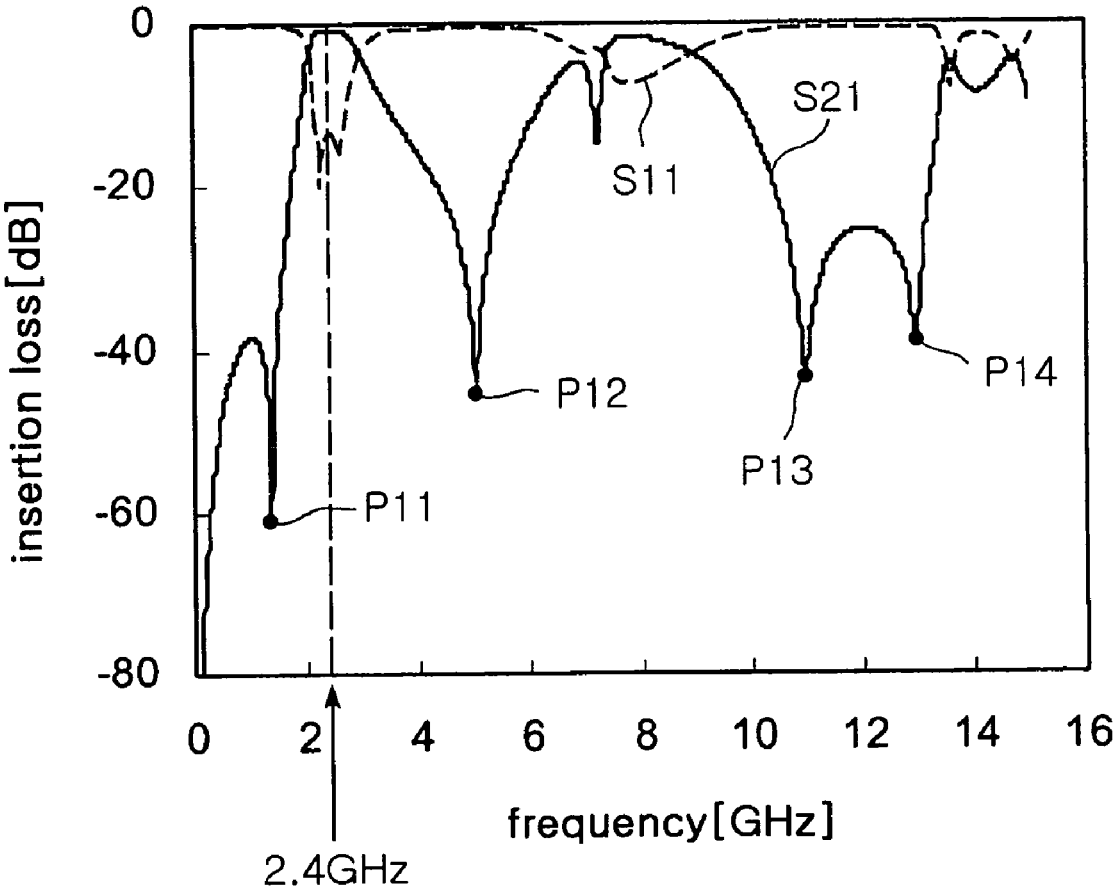
FIG. 7 is a graph illustrating attenuation characteristics of the laminated filter of FIG. 5.

FIG. 7 is a graph illustrating attenuation characteristics of the laminated filter of FIG. 5.

An attenuation pole P11 is formed at a frequency under the pass band of 2.4 GHz, and a plurality of attenuation poles P12, P13, and P14 are formed at frequencies above the pass band of 2.4 GHz. As such, the present invention improved the attenuation characteristics, compared with the prior art, such that the attenuation poles occur at frequencies under and above the pass band.

Especially, with reference to FIGS. 5 to 7, if the amounts of coupling between the first and the second feeding lines 122 and 132 and the first and the second resonator patterns 111 and 112 are adjusted, and if the lengths of the first and the second feeding lines 122 and 132 are adjusted, positions of attenuation poles P11 to P14 of stop band can be controlled to acquire a stop band characteristic.

Figure 8:
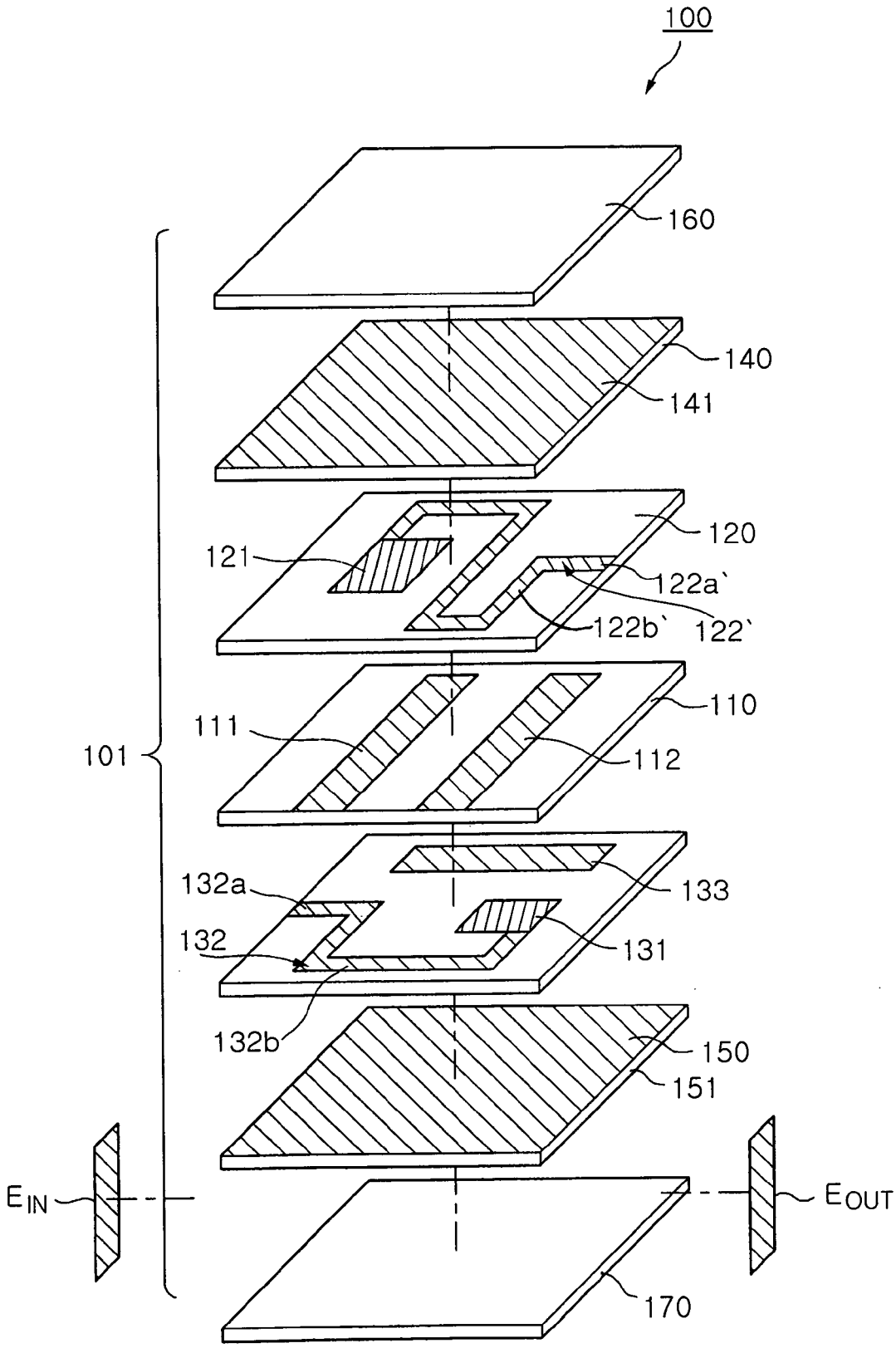
FIG. 8 is a view illustrating a modification of the laminated filter of FIG. 5.

FIG. 8 is a view illustrating a modification of the laminated filter of FIG. 5. Namely, the modified laminated filter of FIG. 8 is similar to the laminated filter shown in FIG. 7. Therefore, the reference numerals used in FIG. 8 are the same as those of FIG. 7 for the same elements. Thus, the same elements will not be described in detail. Also, such a situation is identically applied to FIGS. 9 and 10.

Referring to FIGS. 5 to 8, the first feeding line 122' includes a first pattern 122*a*' connected to the input electrode Ein or the output electrode Eout, and second pattern 122*b*' connecting the first pattern 122*a* to the first mutual capacitor pattern 121. The second pattern 122*b*' is formed to be superposed with each of the first and second resonator patterns 111 and 112 to form capacitive coupling associating with the first and the second resonator patterns 111 and 112. Unlike the second pattern 122*b* of the first feeding line 122 shown in FIG. 5, the second pattern 122*b*' of the first feeding line 122' of FIG. 8 forms a capacitive coupling as the second pattern 122*b*' is coupled to a part of the second pattern 132*b* of the second feeding line 132.

As mentioned above, in the laminated filter according to the first embodiment of the present invention, the second patterns 122*b* and 132*b* of the first and the second feeding lines 122 and 132 can be implemented with various types of patterns. Based on the patterns, the second patterns 122*b* and 132*b* form cross capacitive coupling as the second patterns 122*b* and 132*b* are coupled to the first and the second resonator patterns 111 and 112, and capacitive coupling as the second patterns 122*b* and 132*b* are coupled to the coupling capacitor pattern 133. Also, the second patterns 122*b* and 132*b* form capacitive coupling between themselves.

Figure 9:
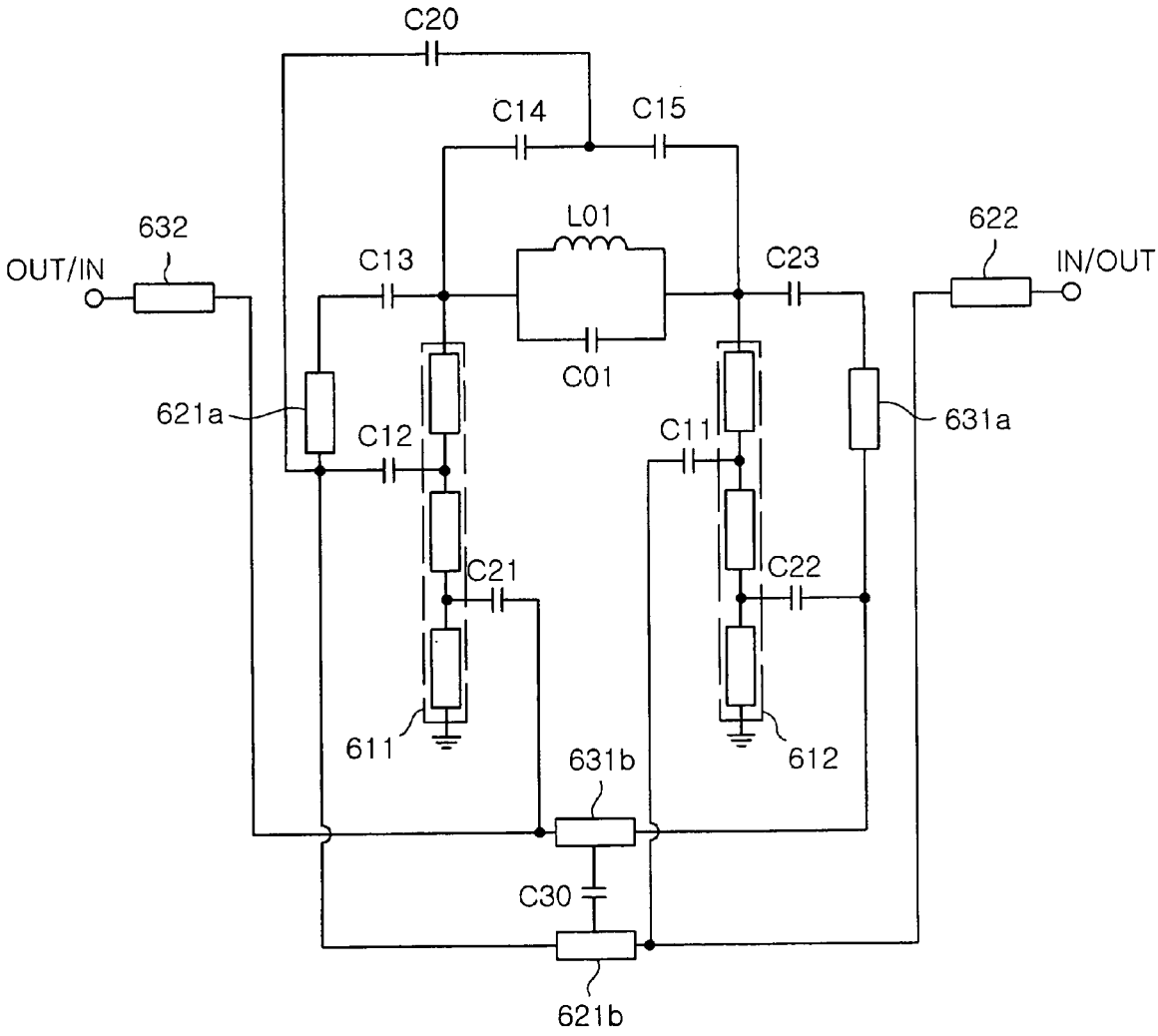
FIG. 9 is an equivalent circuit of the laminated filter of FIG. 8.

FIG. 9 is an equivalent circuit of the laminated filter of FIG. 8.

The equivalent circuit is similar to that of FIG. 6 except for capacitance C30. More specifically, with reference to FIG. 8, the equivalent circuit of FIG. 9 has the capacitance C30 caused by coupling between the second pattern 122*b*' of the first feeding line 122' and a part of the second pattern 132*b* of the second feeding line 132.

Figure 10:
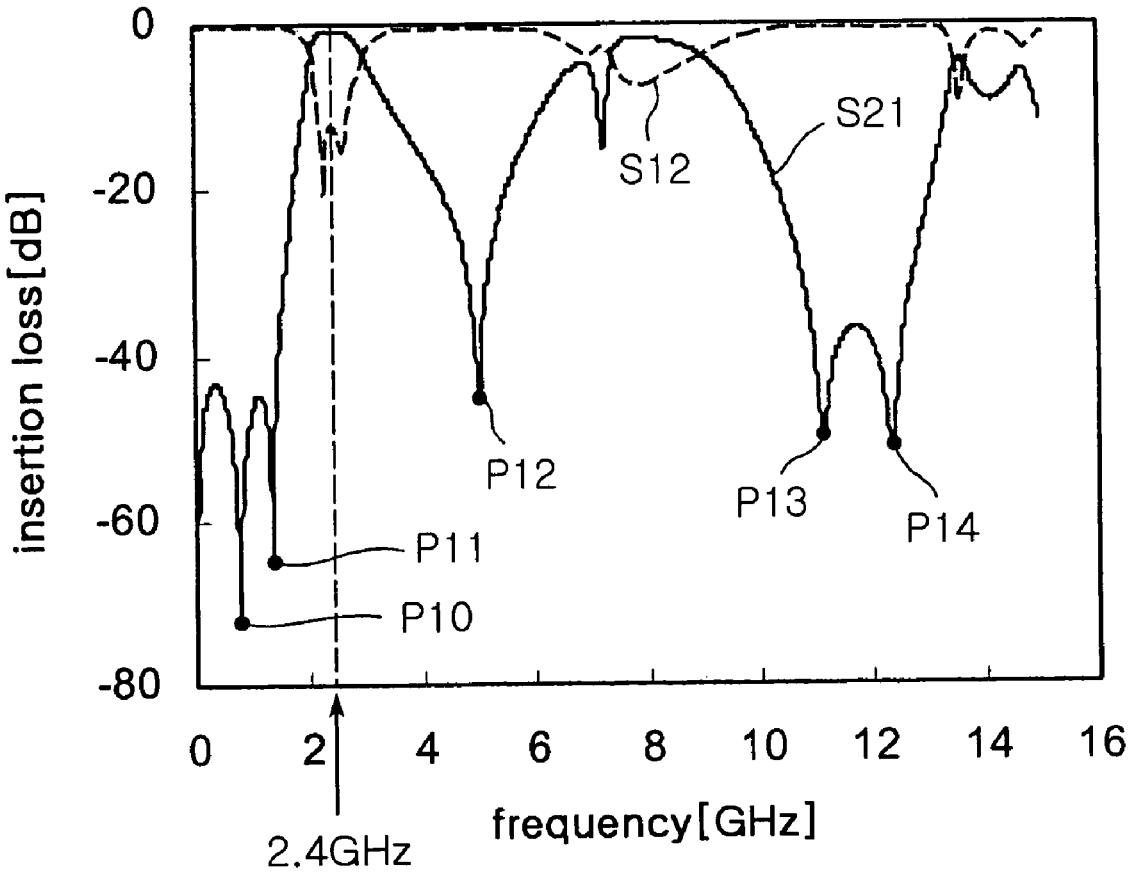
FIG. 10 is a graph illustrating attenuation characteristics of the laminated filter of FIG. 8.

FIG. 10 is a graph illustrating attenuation characteristics of the laminated filter of FIG. 8.

Attenuation poles P10 and P11 are formed at frequencies under the passing band of 2.4 GHz, and a plurality of attenuation poles P12, P13, and P14 are formed at frequencies above the pass band of 2.4 GHz. As such, the present invention improved the attenuation characteristics, compared with the prior art, such that the attenuation poles occur at frequencies under and above the pass band.

Also, with reference to FIGS. 8 to 10, if the amounts of coupling between the first and the second feeding lines 122' and 132 and the first and the second resonator patterns 111 and 112 are adjusted, and if the lengths of the first and the second feeding lines 122' and 132 are adjusted, positions of attenuation poles P10 to P14 of stop band can be controlled to acquire stop band characteristics.

Figure 11:
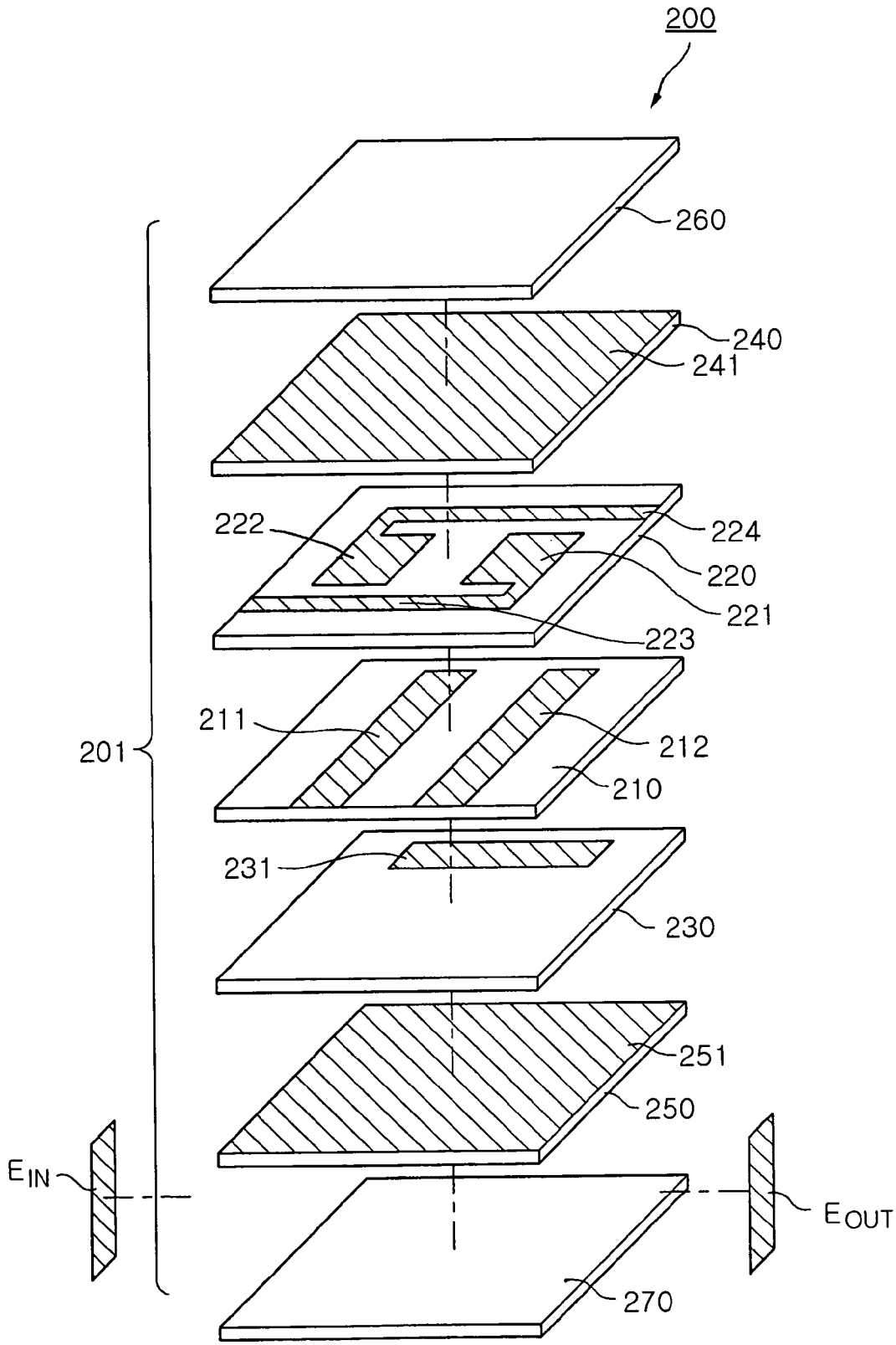
FIG. 11 is an exploded perspective view of the laminated filter according to a second embodiment of the present invention.

FIG. 11 is an exploded perspective view of the laminated filter according to a second embodiment of the present invention.

With reference to FIG. 11, the limited filter of the second embodiment of the present invention includes a laminated layer 200, first and second resonator patterns 211 and 212, first and second mutual capacitor patterns 222 and 221, first and second feeding lines 224 and 223, and a coupling capacitor pattern 231.

The laminated structure 200 includes a plurality of dielectric layers 201, and input and output electrodes Ein and Eout on the external sides of the plurality of dielectric layers 201.

The first and second resonator patterns 211 and 212 are placed on a first dielectric layer 210, in which the first and second resonator patterns 211 and 212 are formed in parallel and space apart from one another by a predetermined distance. Although the first and second resonator patterns 211 and 212 according to the present invention are implemented according to the depiction of FIG. 11, their shapes are not limited thereto.

The first mutual capacitor pattern 222 is formed on a second dielectric layer 220 adjacent to one side of the first dielectric layer 210, and is arranged so as to face a part of one or more of the first and second resonator patterns 211 and 212 to form capacitive coupling therebetween.

The second mutual capacitor pattern 221 is formed on the second dielectric layer 220 and apart from the first mutual capacitor pattern 222 by a predetermined distance. The second mutual capacitor pattern 221 is arranged so as to face a part of one or more resonator pattern of the first and second resonator patterns 211 and 212 to form capacitive coupling therebetween.

The first feeding line 224 is formed on the second dielectric layer 220, and is connected at one end thereof to the first mutual capacitor pattern 222 and at the other end to the input electrode Ein or the output electrode Eout.

The second feeding line 223 is formed on the second dielectric layer 220, and is connected at one end thereof to the second mutual capacitor pattern 221 and at the other end to the output electrode Eout or the input electrode Ein.

The coupling capacitor pattern 231 is formed on the third dielectric layer 230 adjacent to the first dielectric layer 210, and is arranged so as to face each of two or more resonator patterns of the first and second resonator patterns 211 and 212 to form capacitive coupling therebetween.

Similar to the first embodiment of the present invention, the laminated filter according to the second embodiment of the present invention includes grounding electrodes 241 and 251 formed at a fourth dielectric layer 240 and/or a fifth dielectric layer 250, in which the fourth dielectric layer 240 is adjacent to one side of the second dielectric layer 220 and the fifth dielectric layer 250 is adjacent to one side of the third dielectric layer 230, and sixth and seventh dielectric layers 260 and 270, in which the sixth dielectric layer 260 is adjacent to the fourth dielectric layer 240 and the seventh dielectric layer 270 is adjacent to the fifth dielectric layer 250. Also, the sixth and seventh dielectric layers 260 and 270 can function as cover layers.

On the other hand, the grounding electrodes 241 and 251 are electrically connected to the resonator patterns through side termination or via hole.

The first mutual capacitor pattern 222 is wider than the first feeding line 224, so as to form capacitive coupling as the first mutual capacitor pattern 222 is coupled to the first resonator pattern 211. Also, the second mutual capacitor pattern 221 is wider than the second feeding line 223 to form capacitive coupling as the second mutual capacitor pattern 211 is coupled to with the second resonator pattern 212.

The first feeding line 224 is formed to be superposed with each of the first and the second resonator patterns 211 and 212 to form cross capacitive coupling as the first feeding line 224 is coupled to the first and the second resonator patterns 211 and 212. Also, the first feeding line 224 forms capacitive coupling as the first feeding line 224 is coupled to the coupling capacitor pattern 231. The second feeding line 223 is formed to be supposed with each of the first and second resonator patterns 211 and 212 to form cross capacitive coupling as the second feeding line 223 is coupled to the first and the second resonator patterns 211 and 212.

Also, the second feeding line 223 is superposed with the coupling capacitor pattern 231 to form capacitive coupling as the second feeding line 223 is coupled to the coupling capacitor pattern.

As mentioned above, in the laminated filter according to the second embodiment of the present invention, the first and the second feeding lines 224 and 223 are implemented with various shapes, one of which is shown in FIG. 1.

Figure 12:
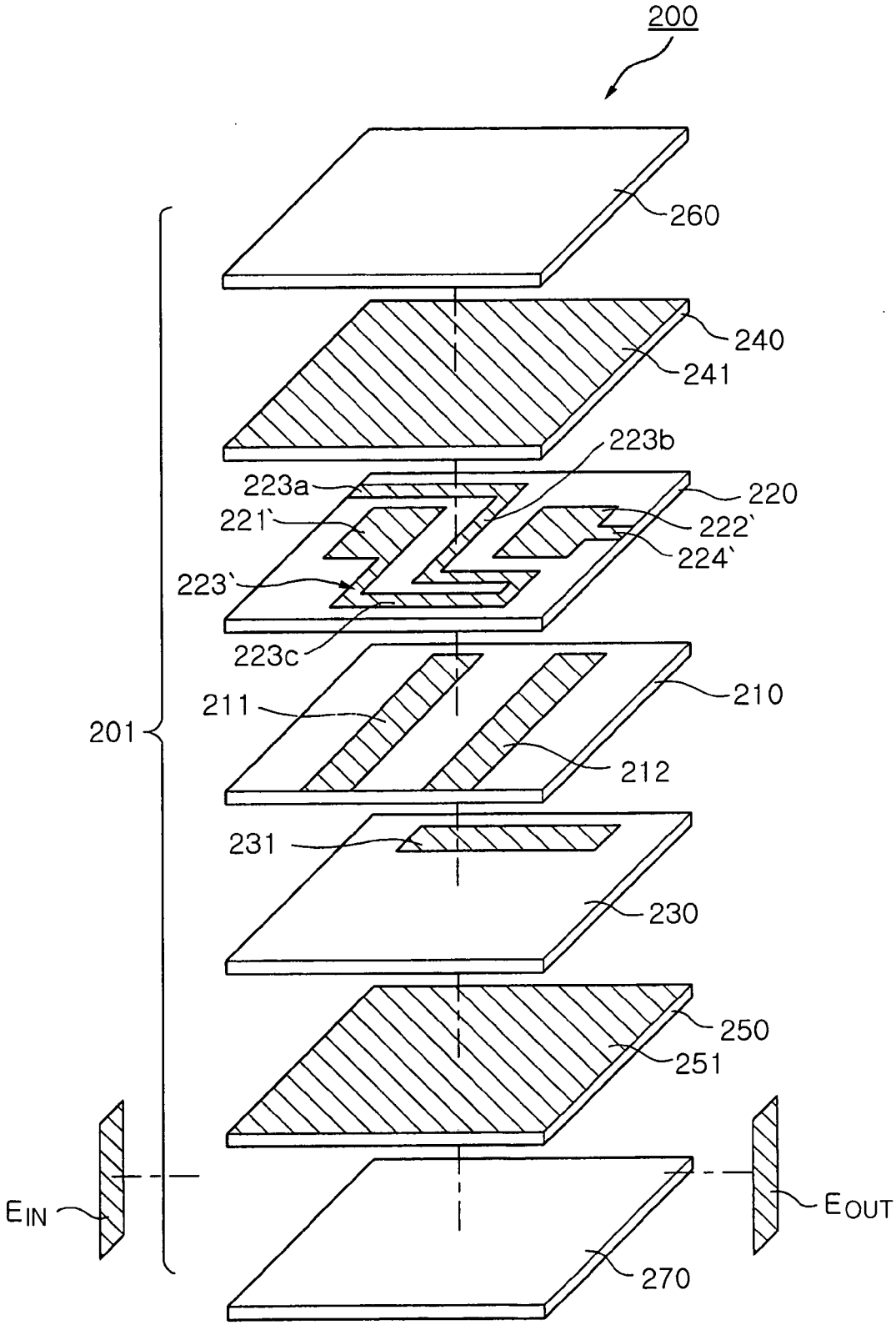
FIG. 12 is a modification of the laminated filter of FIG. 11.

FIG. 12 is a modification of the laminated filter of FIG. 11. Namely, the modified laminated filter of FIG. 12 is similar to the laminated filter shown in FIG. 11. Therefore, the reference numerals used in FIG. 12 are the same as those of FIG. 7 for the same elements. Thus, the same elements will not be described in detail.

With reference to FIGS. 11 and 12, the first mutual capacitor pattern 221' is arranged so as to face a part of the first resonator pattern 211 to form capacitive coupling. The second mutual capacitor pattern 222' is arranged so as to face a part of the second resonator pattern 212 to form capacitive coupling.

The first feeding line of FIG. 12 includes a first pattern 223*a* connected to the input electrode Ein or the output electrode Eout, a second pattern 223*b* connected to one end of the first pattern 223*a*, and a third pattern 223*c* connected between the other end of the second pattern 223*b* the first mutual capacitor pattern 221'.

The first pattern 223*a* of the first feeding line 223' is superposed with the coupling capacitor pattern 231 to form capacitive coupling as the first pattern 223*a* is coupled to the coupling capacitor pattern 231. The third pattern 223*c* of the first feeding line 223' is superposed with each of the first and the second resonator patterns 111 and 112 to form cross capacitive coupling as the third pattern 223*c* is coupled to a part of the first and second resonator patterns 211 and 212.

As mentioned above, the laminated filter according to the present invention has advantages in that an attenuation characteristic can be implemented at a desired stop band, and positions of attenuation poles can be easily adjusted, such that it can be usefully applied to an embedded band pass filter which uses LTCD or multi-layer PCB, etc. Also, when the laminated filter according to the present invention is applied to a balanced type element or module, etc., with a Balun element, the positions of attenuation poles of discrete band pass filters, changed by the Balun element, and the length of the feeding line pattern can be easily adjusted, and the amount of coupling between the feeding line pattern and resonator pattern can be easily adjusted.

The laminated filter according to the present invention can be adopted to devices using a radio frequency, such as communication systems and/or broadcasting systems, such that feeding lines of an input lead and/or an output lead can form cross capacitive coupling associating with resonator patterns, thereby improving an attenuation characteristic of stop band. Also, if the feeding lines of the input lead and output lead are placed on different layers, the laminated filter can be reduced in size, and the positions of the attenuation poles can be controlled by adjusting the feeding line length, thereby enhancing an attenuation characteristic of stop band.

Also, when the laminated filter according to the present invention is manufactured as a module using an LTCC or a PCB, it can be embedded in the board such that the module size can be relatively minimized. In addition, the laminated filter according to the present invention is cost effective because it can be individually replaced within the system. Furthermore, it can be easily implemented with a discrete chip.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A laminated filter with improved stop band attenuation comprising:

a laminated structure including a plurality of dielectric layers and input and output electrodes formed at external sides of the plurality of dielectric layers;

a plurality of resonator patterns each of which is separately formed at a first one of the plurality of dielectric layers with a predetermined interval;

a first mutual capacitor pattern formed at a second dielectric layer of the plurality of dielectric layers adjacent to the first dielectric layer, the first mutual capacitor pattern facing a part of one or more resonator patterns of the plurality of resonator patterns to form capacitive coupling;

a first feeding line formed at the second dielectric layer, the first feeding line having an end connected to the first mutual capacitor pattern and another end connected to the input electrode or the output electrode;

a second mutual capacitor pattern formed at a third dielectric layer adjacent of the plurality of dielectric layers to one side of the first dielectric layer, the second mutual capacitor pattern facing a part of one or more resonator patterns of the plurality of resonator patterns to form capacitor coupling;

a second feeding line formed at the third dielectric layer, the second feeding line having an end connected to the second mutual capacitor pattern and another end connected to the input electrode or the output electrode; and a coupling capacitor pattern formed on the third dielectric layer and spaced from the second capacitor pattern and the second feeding line, the coupling capacitor pattern facing each of two or more resonators of the plurality of resonator patterns to form cross capacitive coupling, wherein the first feeding line includes:

a first pattern connected to the input electrode or the output electrode; and a second pattern connected between the first mutual capacitor pattern and the first pattern, the second pattern forming cross capacitive coupling as the second pattern is coupled to two or more resonator patterns of the plurality of resonators, wherein the second feeding line includes:

a first pattern connected to the input electrode or the output electrode; and a second pattern connected between the second mutual capacitor pattern and the first pattern of the second feeding line, the second pattern forming cross capacitive coupling as the second pattern is coupled to two or more resonator patterns of the plurality of resonators.

2. The filter as set forth in claim 1, further comprising grounding electrodes formed on a dielectric layer of the plurality of dielectric layers adjacent to one side of the second dielectric layer and/or a dielectric layer of the plurality of dielectric layers adjacent to one side of the third dielectric layer.

3. The filter as set forth in claim 1, wherein the second pattern of the first feeding line forms capacitive coupling as the second pattern of the first feeding line is coupled to the coupling capacitor pattern.

4. The filter as set forth in claim 1, wherein the second pattern of the first feeding line forms capacitive coupling as the second pattern of the first feeding line is coupled to a part of the second pattern of the second feeding line.

5. A laminated filter with improved stop band attenuation comprising:

a laminated layer including a plurality of dielectric layers and input and output electrodes formed at external sides of the plurality of dielectric layers;

a plurality of resonator patterns each of which is separately formed at a first dielectric layer of the plurality of dielectric layers with a predetermined interval;

a first mutual capacitor pattern formed at a second dielectric layer of the plurality of dielectric layers adjacent to one side of the first dielectric layer, the first mutual capacitor pattern facing a part of one or more resonator patterns of the plurality of resonator patterns to form capacitor coupling;

a second mutual capacitor pattern formed on the second dielectric layer and apart from the first mutual capacitor pattern, the second mutual capacitor pattern facing a part of one or more resonator pattern of the plurality of resonator patterns to form capacitive coupling;

a first feeding line formed at the second dielectric layer, the first feeding line having an end connected to the first mutual capacitor pattern and another end connected to the input electrode or the output electrode;

a second feeding line formed at the second dielectric layer, the second feeding line having an end connected to the second mutual capacitor pattern and another end connected to the input electrode or the output electrode; and a coupling capacitor pattern formed on a third dielectric layer of the plurality of dielectric layers adjacent to one side of the first dielectric layer, the coupling capacitor pattern facing each of two or more resonators of the plurality of resonator patterns to form cross capacitive coupling therebetween, wherein the first feeding line forms cross capacitive coupling as the first feeding line is coupled to two or more resonator patterns of the plurality of resonators, wherein the second feeding line forms cross capacitive coupling as the second feeding line is coupled to two or more resonator patterns of the plurality of resonators.

6. The filter as set forth in claim 5, further comprising grounding electrodes formed on a dielectric layer of the plurality of dielectric layers adjacent to one side of the second dielectric layer and/or a dielectric layer of the plurality of dielectric layers adjacent to one side of the third dielectric layer.

7. The filter as set forth in claim 5, wherein the first feeding line forms capacitive coupling as the first feeding line is coupled to the coupling capacitor pattern.

* * * * *